US006011534A

United States Patent [19]

Tanaka et al.

[11] Patent Number: 6,011,534

[45] Date of Patent: Jan. 4, 2000

[54] DRIVING CIRCUIT FOR IMAGE DISPLAY DEVICE INCLUDING SIGNAL GENERATOR WHICH GENERATES AT LEAST TWO TYPES OF SAMPLING PULSE TIMING SIGNALS HAVING PHASES THAT DIFFER FROM EACH OTHER

[75] Inventors: Manabu Tanaka, Sakurai; Katsuya Mizukata, Shijonawate, both of Japan

[73] Assignee: Sharp Kabushiki Kaisha, Osaka, Japan

[21] Appl. No.: 08/726,363

[22] Filed: Oct. 4, 1996

[30] Foreign Application Priority Data

Oct. 5, 1995 [JP] Japan ..... 7-259037

[51] Int. Cl.[7] ..... G09G 3/36

[52] U.S. Cl. ..... 345/98; 345/100; 345/213; 345/99

[58] Field of Search ..... 345/99, 87, 98, 345/213, 100

[56] References Cited

U.S. PATENT DOCUMENTS

| | | | |
|---|---|---|---|
| 4,694,349 | 9/1987 | Takeda et al. | 348/793 |
| 5,168,270 | 12/1992 | Masumori et al. | 345/100 |
| 5,229,761 | 7/1993 | Fuse | 345/99 |
| 5,610,627 | 3/1997 | Inamori et al. | 345/99 |
| 5,642,138 | 6/1997 | Hijikata et al. | 345/200 |
| 5,748,167 | 5/1998 | Watanable et al. | 345/98 |
| 5,796,379 | 8/1998 | Enomoto et al. | 345/89 |

FOREIGN PATENT DOCUMENTS

| | | |
|---|---|---|
| 7-28426 | 1/1995 | Japan . |
| 7-319420 | 12/1995 | Japan . |

*Primary Examiner*—Dennis-Doon Chow
*Assistant Examiner*—Amr Awad

[57] ABSTRACT

A driving circuit for an image display device includes a signal generating circuit for generating an initiation control signal for controlling the initiation of sampling of a video signal to be input, and a sampling pulse timing signal for determining timing of sampling. When a set of discrete signals is input as the video signal, the signal generating circuit generates two sampling pulse timing signals whose phases differ from each other, selects one of the sampling pulse timing signals alternately in each horizontal scanning period, and outputs the selected sampling pulse timing signal to a shift register in a source driver. The signal generating circuit also switches the output signal between the two sampling pulse timing signals in a set of four fields.

17 Claims, 12 Drawing Sheets

FIG. 3

| | | | | | | | | | | | |
|---|---|---|---|---|---|---|---|---|---|---|---|
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |
| R | G | B | R | G | B | R | G | B | R | G | B |

FIG. 4(a) CSYN
FIG. 4(b) FR
FIG. 4(c) FR1
FIG. 4(d) SPD
FIG. 4(e) CLD1
FIG. 4(f) CLD2
FIG. 4(g) CLD

DRIVING CIRCUIT FOR IMAGE DISPLAY DEVICE INCLUDING SIGNAL GENERATOR WHICH GENERATES AT LEAST TWO TYPES OF SAMPLING PULSE TIMING SIGNALS HAVING PHASES THAT DIFFER FROM EACH OTHER

FIELD OF THE INVENTION

The present invention relates to a driving circuit for an image display device such as a liquid crystal display device, and particularly relates to a driving circuit for an image display device capable of displaying an image based on television broadcast signals and an image based on computer signals, for example, capable of being used with both a television receiver and a navigation system designed for automobiles.

BACKGROUND OF THE INVENTION

A compact, light-weight, power-saving liquid crystal display device is generally used as a display monitor of a car navigation system which provides positional information of a car and various driving guide information. Such a display device is not only used as the monitor of the car navigation system, but also often used as a monitor for displaying television pictures.

FIG. 11 is a block diagram showing an example of the structure of a conventional driving circuit for an active matrix driving-type liquid crystal display device using a TFT (thin film transistor) as a switching element.

A signal generating circuit 60 includes a PLL circuit 50. The PLL circuit 50 is formed by a phase comparator 50*a*, an integrator 50*b*, a voltage control oscillator (VCO) 50*c*, and a divider (H counter) 50*d*. A composite synchronizing signal CSYN is input as an input signal to the PLL circuit 50. The voltage control oscillator 50*c* oscillates a signal at a frequency corresponding to a horizontal synchronizing signal HSYN of the input composite synchronizing signal CSYN. The oscillated signal is input to the divider 50*d*. The divider 50*d* generates a timing signal in a horizontal direction using the oscillated signal as a clock. The timing signal is output to a decoding circuit 51 from the divider 50*d*.

The decoding circuit 51 converts the timing signal into a source driver controlling signal, and also generates a signal CKV to be output to a divider (V counter) 52. The divider 52 uses the signal CKV as a clock to generate a timing signal in a vertical direction, and outputs the timing signal to a decoding circuit 53. The divider 52 is reset by a vertical synchronizing signal VSYN of the composite synchronizing signal CSYN, and operated based on the vertical synchronizing signal VSYN as a reference. The decoding circuit 53 converts the timing signal output from the divider 52 into a gate driver control signal. More specifically, the gate driver control signal is composed of two signals, SPS, and CLS. Both of the signals SPS and CLS are output to a gate driver 54 from the decoding circuit 53. The gate driver 54 controls a vertical direction for switching the TFT.

The source driver control signal generated by the decoding circuit 51 is used for sampling and holding data, and is composed of two signals SPD and CLD. The signal SPD is an initiation control signal for controlling the initiation of sampling. The signal CLD is a sampling pulse timing signal. Both of the signals SPD and CLD are output to a shift register of a source driver 55 from the decoding circuit 51. Each unit of the shift register generates one sampling pulse every horizontal scanning period based on both the signals SPD and CLD, and outputs the sampling pulse to a sample-and-hold circuit 58, to be described later, in the source driver 55.

FIG. 12 is a view explaining a simplified structure of the sample-and-hold circuit 58 in the source driver 55. The number of the sample-and-hold circuits 58 is the same as the number of source bus lines SL in a liquid crystal panel 56 shown in FIG. 11. A video signal Vs used exclusively for a liquid crystal (TFT) is input to each of the sample-and-hold circuit 58. The polarity of the video signal Vs is inverted every horizontal scanning period and every vertical scanning period so as to prevent the application of a direct-current voltage to the liquid crystal and flicker on the display.

The voltage of the video signal Vs is charged in a sampling capacitor C1 during the time in which a switch SW1 is opened by a sampling pulse. The charged voltage is held for one horizontal scanning period, and then transferred to a holding capacitor C2 when a switch SW2 is opened by a transfer pulse. The transferred voltage is output as a signal voltage to the source bus lines SL in the liquid crystal panel 56 through an impedance converter (output buffer) 59.

As illustrated in FIG. 11, in the liquid crystal panel 56, a number of gate bus lines (horizontal scanning lines) GL and a number of source bus lines SL are arranged to cross each other. One pixel 57 is formed in each region enclosed by adjacent gate bus lines GL and adjacent source bus lines SL. The pixels 57 as a whole are arranged in a matrix form. Formed in each pixel 57 are a TFT as a switching element, and a pixel electrode for applying the signal voltage to the liquid crystal. In each pixel 57, the gate of the TFT is connected to the gate bus line GL and the pixel electrode is connected to the source bus line SL through the drain and source of the TFT.

Moreover, the liquid crystal panel 56 includes a striped color filter in which red, green, and blue filters are alternately and repeatedly formed as stripes. A sequence of adjacent three pixels 57 function as a pixel indicating red, a pixel indicating green, and a pixel indicating blue, respectively, thereby forming one set of dots for display.

A pulse for switching the TFT on is output to the gate bus line GL from a shift register in the gate driver 54 in synchronism with the output of the signal voltage to the source bus lines SL from the source driver 55. A signal voltage is applied only to the pixel 57 located on the gate bus line GL to which the ON pulse is input, and the pixel 57 holds this voltage for an OFF period (one vertical scanning period). By repeating this process from the first line through the last line of the gate bus lines GL, a picture in one vertical scanning period is displayed.

In the case when the video signal Vs input to the sample-and-hold circuit 58 is a continuously varying signal (analog signal) such as a television broadcast signal, sampling is performed by time-division by which the display range of the input video signal Vs is divided at time intervals corresponding to the number of dots in the liquid crystal panel 56 as shown in FIG. 13. In FIG. 13, voltages V1, V2, and V3 in the first line (one horizontal scanning period) of the video signal Vs are sampled by sampling pulses S1, S2, and S3, respectively. Voltages −V1, −V2, and −V3 in the second line (one horizontal scanning period) of the video signal Vs are sampled by sampling pulses S4, S5, and S6, respectively. In the case of the above-mentioned sampling pulses, S1 and S4 are sampling pulses produced by one circuit. Similarly, S2 and S5 are produced by one circuit, and S3 and S6 are produced by one circuit. In this sampling method, the video signal Vs and the sampling pulses S1 to S6 are not directly synchronized using a data latch circuit, for example. Moreover, since the color filter of the liquid crystal panel 56 has striped alignments, the timing of sampling is always in phase in the respective lines (horizontal scanning periods).

However, if a liquid crystal display device incorporating the above-mentioned driving circuit is used as a display device capable of being used with both a television receiver and a navigation system designed for use in an automobile, the following drawbacks arise.

In the case when the video signal Vs input to the sample-and-hold circuit 58 is a set of discrete signals like digital signals output by a computer, for example, if the video signal Vs and the sampling pulse Sa has, for example, the phase relationship between Vs1 and Sa1 shown in FIG. 14, a voltage Vd is charged in the sampling capacitor C1. However, if the video signal Vs and the sampling pulse Sa has the phase relationship between Vs2 and Sa2, for example, no voltage is charged in the sampling capacitor C1. Consequently, no voltage is applied to the liquid crystal, and a proper display cannot be achieved. For instance, if an attempt is made to display a vertical line at the timing of the video signal Vs2, the vertical line is not displayed.

Thus, in the conventional driving system, when the sampling pulse Sa and the video signal Vs as data are out of phase, sampling cannot be performed, and loss of data sometimes occurred on the display. For instance, data loss sometimes occurred as described above when the video signal Vs was a digital signal output by a computer and data (360 dots in a horizontal direction) was slightly greater than the number of dots on a panel (320 dots in a horizontal direction).

SUMMARY OF THE INVENTION

In order to solve the above problem, it is an object of the present invention to provide a driving circuit for an image display device capable of fetching data and preventing loss of data on the display even when a set of discrete signals is input as a video signal.

In order to achieve the above object, a driving circuit for an image display device of the present invention includes:

signal generating means for generating an initiation control signal for controlling the initiation of sampling of a video signal to be input and a sampling pulse timing signal for determining a timing of sampling based on an input composite synchronizing signal;

sampling pulse generating means for generating a sampling pulse based on the initiation control signal and the sampling pulse timing signal; and a sample-and-hold circuit for sampling and holding an input video signal in each horizontal scanning period of every horizontal scanning line at the timing of the sampling pulse, wherein when a set of discrete signals is input as the video signal, the signal generating means generates at least two types of sampling pulse timing signals whose phases differ from each other, selects one type from these types of sampling pulse timing signals by turn for each horizontal scanning period, and outputs the selected sampling pulse timing signal to the sampling pulse generating means.

In this structure, the relationship between the phase of the sampling pulse and the phase of the video signal can be changed every horizontal scanning period. Therefore, even in an image display device using a driver which does not use a data latch circuit, for example, to directly synchronize the phases of the sampling timing and data, when a set of discrete signal is input as the video signal, it is possible to fetch data which cannot be fetched by conventional systems because the sampling pulse and the video signal as data are out of phase.

In particular, it is possible to correct a data voltage which cannot be sampled when a video signal containing data whose volume is greater than the number of dots on a display panel is input, or when a shortage of the sampling time occurs due to an increase in the number of dots, and display the image of data.

In this structure, since an increased volume of data can be fetched compared to a conventional structure, it is possible to improve an image displayed and achieve an excellent display.

One example of the image display device in which the above-mentioned driving circuit is suitably used is a liquid crystal display device including a liquid crystal panel having a striped color filter. In this case, even when a set of discrete signals is input as the video signal in a liquid crystal display device including the striped color filter and an analog source driver in which the timing of sampling and timing of data are not synchronized by, for example, a data latch circuit, it is possible to fetch an increased volume of data compared to a conventional structure. Consequently, the image displayed on the liquid crystal display device is improved, and an excellent display is achieved.

Moreover, in the above-mentioned structure, it is preferred that the above-mentioned at least two types of sampling pulse timing signals generated by the signal generating means are two types of sampling pulse timing signals, and the signal generating means selects one type from the two types of sampling pulse timing signals alternately in each horizontal scanning period, and outputs the selected sampling pulse timing signal to the sampling pulse generating means. In this case, the signal generating means achieves the generation of two types of sampling pulse timing signals with a relatively simple circuit structure, and selectively outputs to the sampling pulse generating means one type of sampling pulse timing signal alternately in each horizontal scanning period. It is thus possible to change the relationship between the phase of the sampling pulse and the phase of the video signal every horizontal scanning period with a relatively simple circuit structure.

Further to the above-mentioned structure, it is preferred that the signal generating means switches the two types of sampling pulse timing signals in a set of four fields for the same horizontal scanning line, and outputs the sampling pulse timing signal to the sampling pulse generating means. In this case, when sampling a voltage to be applied to dots on the same horizontal scanning line, it is possible to change the relationship between the phase of the sampling pulse and the phase of the video signal in the set of four fields. As a result, the voltage is certainly applied to dots in each horizontal scanning line in the four fields, thereby perfectly preventing loss of data on the display.

In addition, in the above-mentioned structure, it is preferred that the signal generating means alternately switches the two types of sampling pulse timing signals in a set of four fields for the same horizontal scanning line so that at least one type of sampling pulse timing signal is output in consecutive two fields, and outputs the sampling pulse timing signal to the sampling pulse generating means. In other words, in this structure, the signal generating means switches the two types of sampling pulse timing signals every other field for the same horizontal scanning line, and outputs the sampling pulse timing signal to the sampling pulse generating means.

In this structure, when sampling a voltage to be applied to the dots on the same horizontal scanning line, it is possible to change the relationship between the phase of the sampling pulse and the phase of the video signal so that at least one type of sampling pulse timing signal is output in consecutive two fields among the four fields (i.e., it is possible to change the phase relationship every other field). Therefore, since the voltage is certainly applied to the dots on each horizontal scanning line in the four fields, it is possible to perfectly prevent loss of data on the display.

Furthermore, when the polarity of a video signal to be input is inverted every vertical scanning period, it is possible to remove the direct voltage and apply the alternating voltage to the respective dots by changing the relationship between the phase of the sampling pulse and video signal so that one type of sampling pulse timing signal is output in consecutive two fields (i.e., the phase relationship is changed every other field). As a result, a driving circuit suitable for use in a liquid crystal display device can be provided.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

For a fuller understanding of the nature and advantages of the invention, reference should be made to the ensuing detailed description taken in conjunction with the accompanying drawings, which are given by way of illustration only and thus are not limitative to the present invention, and wherein:

FIG. 3 is a view schematically explaining the structure of a striped color filter.

DESCRIPTION OF THE PREFERRED EMBODIMENT

The following description will discuss one embodiment of the present invention with reference to FIGS. 1 to 10.

Figure 1:
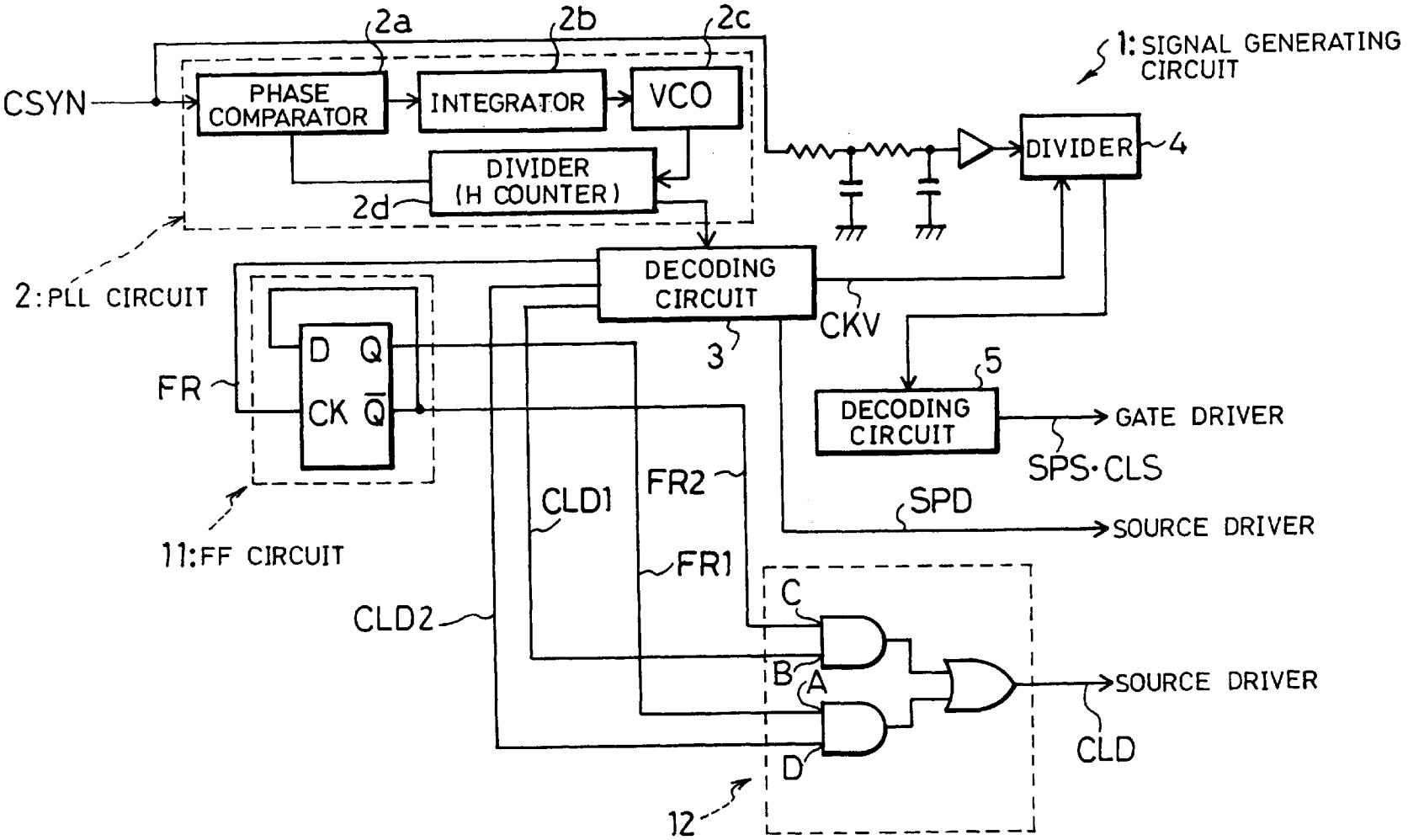
FIG. 1 is a block diagram showing the structure of a signal generating circuit for a liquid crystal display device according to one embodiment of the present invention.

FIG. 1 is a block diagram showing the structure of a signal generating circuit of a liquid crystal display device according to this embodiment. The signal generating circuit 1 is a circuit for outputting to a gate driver 6 and a source driver 7, to be described later, signals generated based on a horizontal synchronizing signal HSYN and a vertical synchronizing signal VSYN of an input composite synchronizing signal CSYN. The signal generating circuit 1 includes a PLL circuit 2, a decoding circuit 3, a divider (V counter) 4, a decoding circuit 5, FF (flip-flop) circuit 11, and a signal switching circuit (AND-AND-OR gate) 12.

Figure 2:
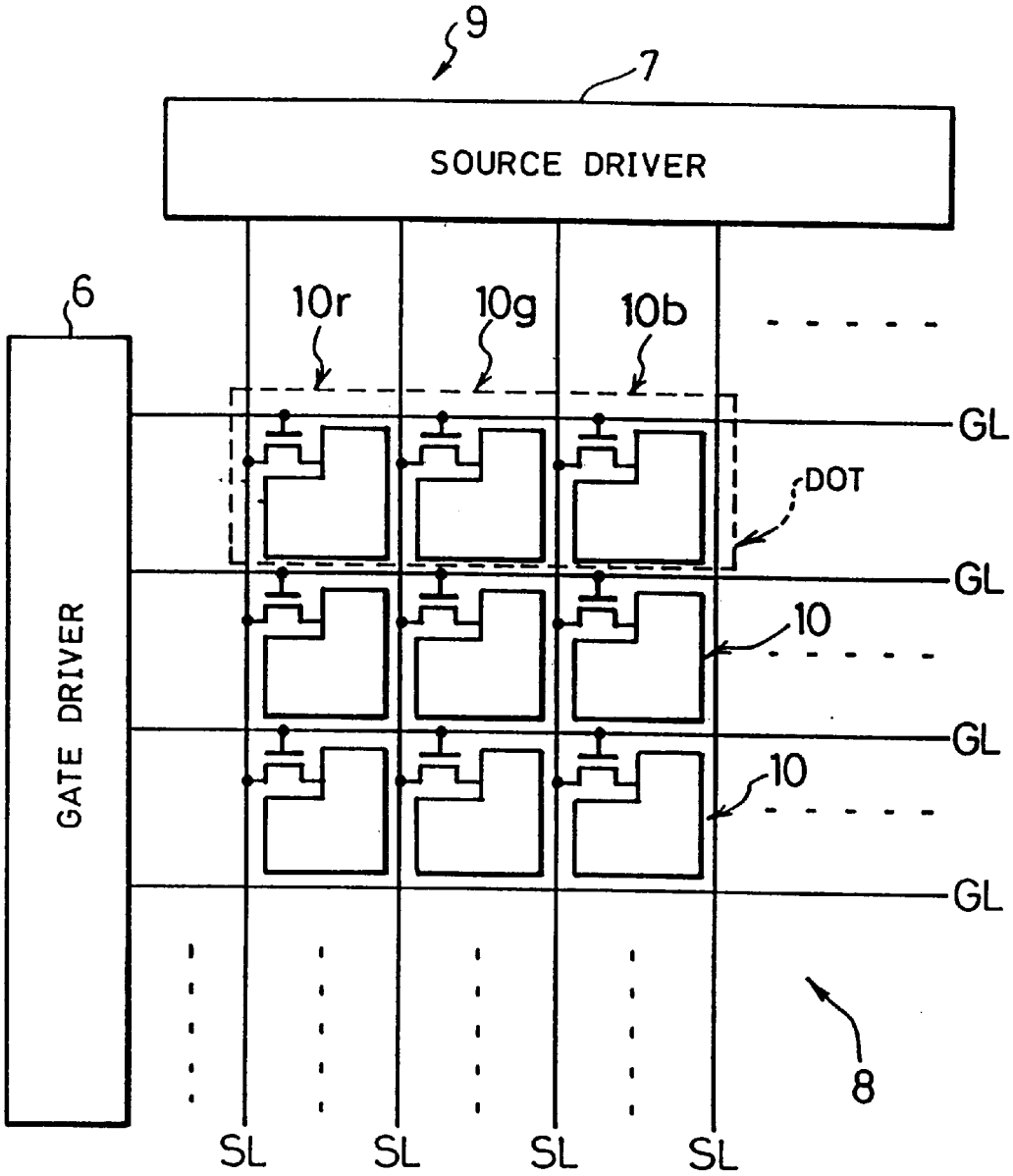
FIG. 2 is a view schematically explaining the structure of a liquid crystal panel of the liquid crystal display device.

FIG. 2 is a view schematically explaining the structure of a liquid crystal panel 9 of a liquid crystal display device incorporating the signal generating circuit 1. The liquid crystal panel 9 includes a pixel array (display section) 8, the gate driver 6, and the source driver 7. In the pixel array 8, a number of gate bus lines (horizontal scanning lines) GL and a number of source bus lines SL are arranged to cross each other. The gate driver 6 outputs to the gate bus lines GL a pulse used for switching a TFT (thin film transistor) based on a gate driver control signal generated by the signal generating circuit 1. On the other hand, the source driver 7 samples and holds a video signal as a signal voltage and outputs the sampled signal voltage to the source bus lines SL based on a source driver control signal generated by the signal generating circuit 1.

In the pixel array 8, one pixel 10 is formed in each region enclosed by adjacent gate bus lines GL and adjacent source bus lines SL, and the pixels 10 as a whole are arranged in a matrix form. Formed in each pixel 10 are a TFT as a switching element, and a pixel electrode for applying the signal voltage to a liquid crystal. In each pixel 10, the gate of the TFT is connected to the gate bus line GL, and the pixel electrode is connected to the source bus line SL through the drain and source of the TFT.

As illustrated in FIG. 3, the liquid crystal panel 9 includes a striped color filter produced by alternately and repeatedly arranging a red filter R, a green filter G, and a blue filter B as stripes. A set of three adjacent pixels 10 function as a pixel 10*r* for displaying a red color, a pixel 10*g* for displaying a green color, and a pixel 10*b* for displaying a blue color so as to form a set of dots for display as shown in FIG. 2.

In the liquid crystal display device, the light transmittance of the liquid crystal varies depending on a signal voltage to be applied to the respective pixel electrodes. An image is displayed by modulating incident light according to the variation of the light transmittance and by transmitting the modulated light.

Next, the following description will discuss a method for applying the signal voltage to the respective pixel electrodes of the liquid crystal panel 9 by the signal generating circuit 1, the gate driver 6 and the source driver 7.

As illustrated in FIG. 1, the PLL circuit 2 includes a phase comparator 2*a*, an integrator 2*b*, a voltage control oscillator (VCO) 2*c*, and a divider (H counter) 2*d*. The voltage control oscillator 2*c* oscillates a signal at a frequency corresponding to a horizontal synchronizing signal HYSN of a composite synchronizing signal CSYN input to the phase comparator 2*a*. An output from the phase comparator 2*a* is smoothed in the integrator 2*b*, and is then supplied to the voltage control oscillator 2*c*. The divider 2*d* generates a timing signal in a horizontal direction using the oscillated signal from the voltage control oscillator 2*c* as a clock. The timing signal is output to the decoding circuit 3.

The decoding circuit 3 generates a source driver control signal based on the timing signal output from the divider 2*d*, and also generates a pulse FR of one horizontal scanning period to be output to the FF circuit 11 and a signal CKV to be output to the divider 4. The divider 4 uses the signal CKV as a clock to generate a timing signal in a vertical direction, and outputs the timing signal to the decoding circuit 5. The divider 4 is reset by a vertical synchronizing signal VSYN of the composite synchronizing signal CSYN, and operated by the vertical synchronizing signal VSYN as a reference. The decoding circuit 5 converts the timing signal output from the divider 4 into a gate driver control signal. More specifically, the gate driver control signal is composed of two signals, SPS, and CLS. Both of the signals SPS and CLS are output to the gate driver 6 form the decoding circuit 5.

The source driver control signal is used for sampling and holding data. Three signals SPD, CLD1, and CLD2 are output from the decoding circuit 3. The signal SPD is an initiation control signal for controlling the initiation of sampling. The signals CLD1 and CLD2 are both sampling pulse timing signals. However, the phases of the signals CLD1 and CLD2 sightly differ from each other as shown in FIGS. 4(*e*) and 4(*f*).

The two signals, CLD1 and CLD2, generated by the decoding circuit 3 are sent to input terminals B and D of the signal switching circuit 12, respectively. The pulse FR is sent to the FF circuit 11 where it is divided in half. A signal FR1 from the Q output and a signal FR2 from the $\overline{Q}$ output of the FF circuit 11 are sent to input terminals A and C of the signal switching circuit 12, respectively.

Figure 4:
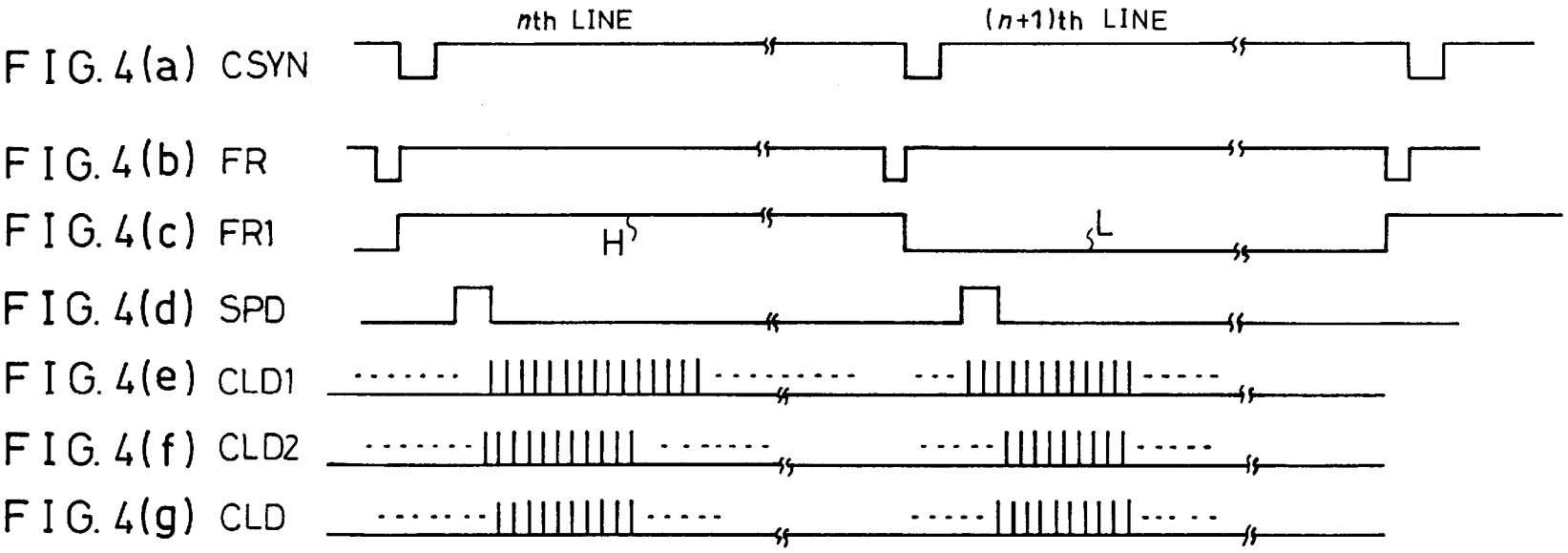
FIGS. 4(*a*) to 4(*g*) are timing charts showing the waveform of signals on the nth line and the (n+1)th line.

As illustrated in FIG. 4, when the signal FR1 is at H level, the signal CLD 2 is output as an output signal CLD to the source driver 7 from the signal switching circuit 12. On the other hand, when the signal FR1 is at L level, the signal CLD 1 is output as an output signal CLD to the source driver 7 from the signal switching circuit 12. Thus, the signal generating circuit 1 can alternately output one of two signals CLD1 and CLD2 whose phases are different from each other to the source driver 7 in each horizontal scanning period.

Moreover, the signal generating circuit 1 switches the output signal CLD between two signals CLD1 and CLD2 in a set of four fields as to be described later.

Figure 5:
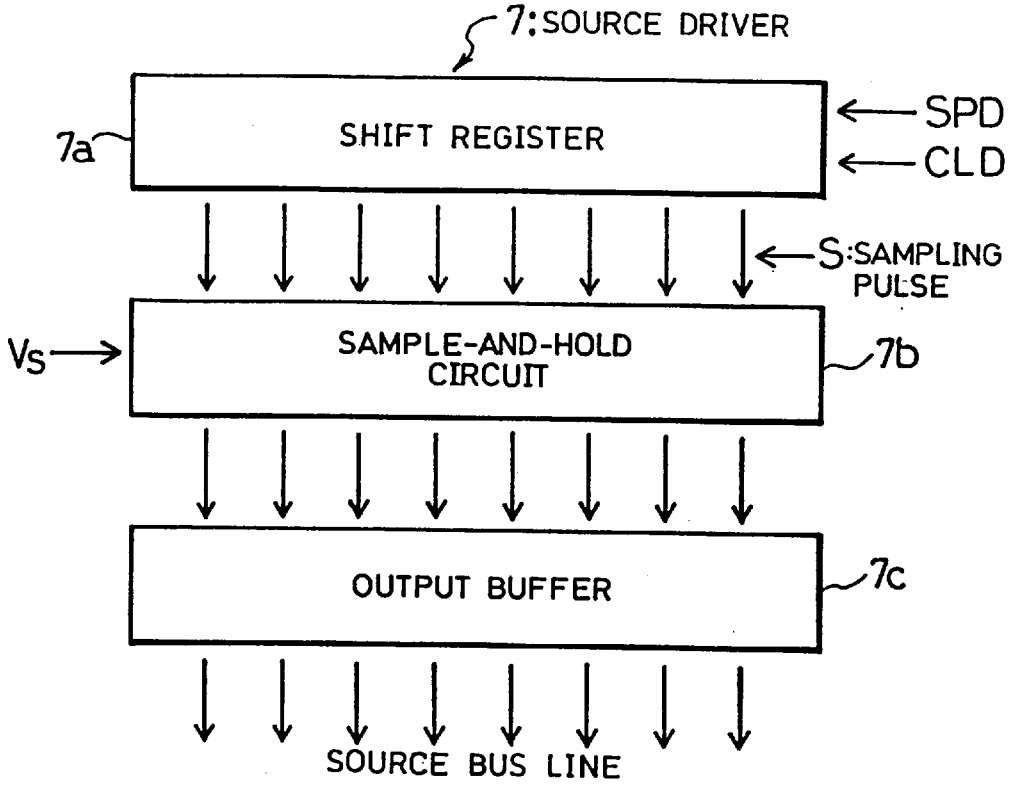
FIG. 5 is a view schematically explaining the structure of a source driver in the liquid crystal display device.
Figure 7:
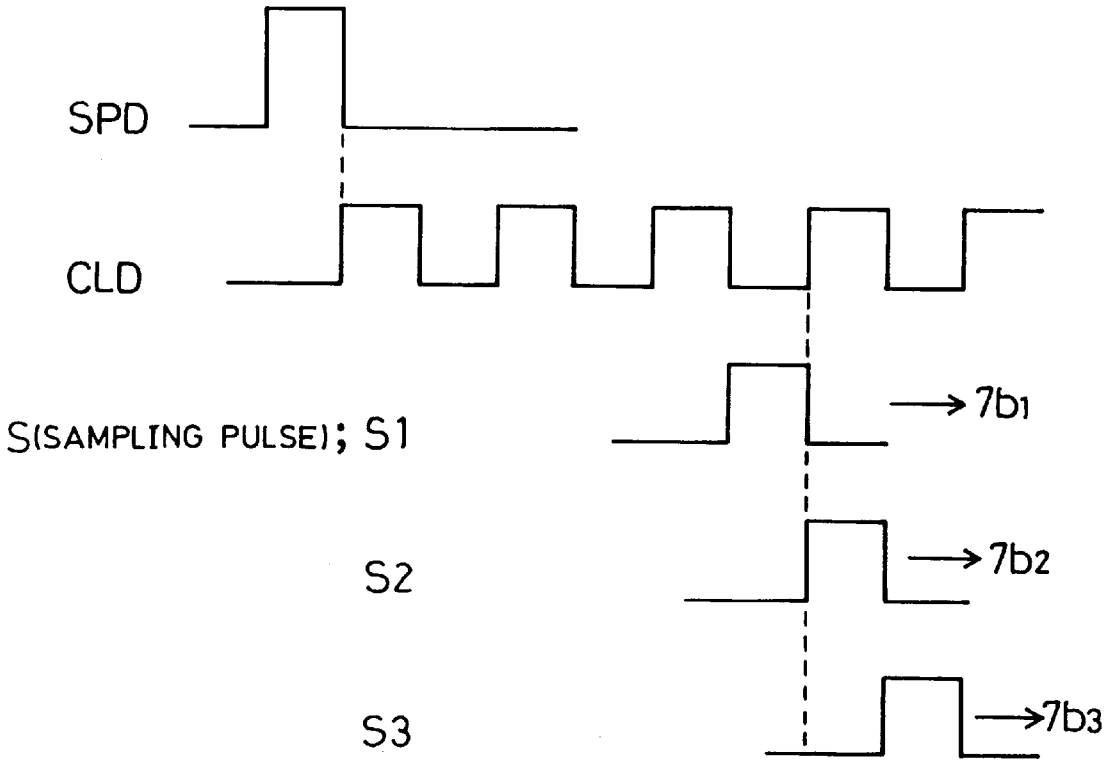
FIG. 7 is a waveform for schematically explaining the generation of a sampling pulse by a shift register in the liquid crystal display device.

The output signal CLD from the signal switching circuit 12 and a signal SPD output from the decoding circuit 3 are input to a shift register 7*a* in the source driver 7 as shown in FIG. 5. Each unit of the shift register 7*a* generates one sampling pulse S every horizontal scanning period based on the signals SPD and CLD, and outputs the sampling pulse S to a sample-and-hold circuit 7*b* in the source driver 7. The same number of the sample-and-hold circuits 7*b* as the number of the source bus lines SL are present in the source driver 7, and the sampling pulse S is input to each of the sample-and-hold circuits 7*b*. As illustrated in FIG. 7, for example, in the shift register 7*a*, if the sampling pulse S is successively generated on the third clock of the signal CLD from the fall of the signal SPD, sampling pulses S1, S2, and S3 are input to the sample-and-hold circuits $7b_1$, $7b_2$, and $7b_3$, respectively.

Figure 6:
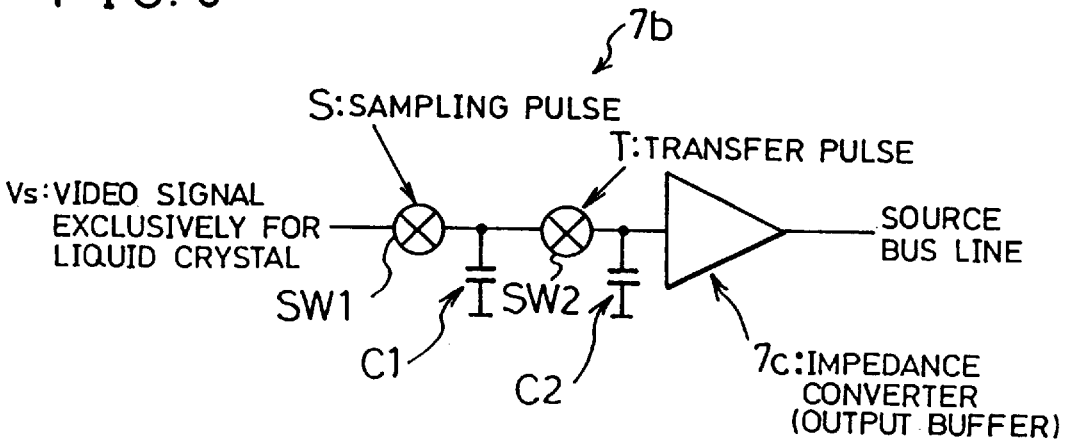
FIG. 6 is a view schematically explaining the structure of a sample-and-hold circuit in the liquid crystal display device.

FIG. 6 is a view schematically explaining the structure of each sample-and-hold circuit 7*b*. Each sample-and-hold circuit 7*b* includes a sampling capacitor C1, a holding capacitor C2, and switches SW1 and SW2 which are opened by the sampling pulse S and a transfer pulse T, respectively. A video signal Vs used exclusively for a liquid crystal is input to each of the sample-and-hold circuits 7*b*. In order to prevent the application of a direct-current voltage to the liquid crystal and flicker on the display, the polarity of the video signal Vs to be input is inverted every horizontal scanning period and every vertical scanning period.

In each sample-and-hold circuit 7*b*, the voltage of the video signal Vs is charged in the sampling capacitor C1 during a period in which the switch SW1 is opened by the sampling pulse S. After holding the charged voltage for one horizontal scanning period, the switch SW2 is opened by the transfer pulse T. As a result, the voltage is transferred to the holding capacitor C2. This signal voltage is output to the source bus line SL in the liquid crystal panel 9 through an impedance converter (output buffer) 7*c*. In synchronous with the output, a switching pulse for switching the TFT on is output to the gate bus line GL in the liquid crystal panel 9 by a shift register in the gate driver 6. The signal voltage is applied only to the pixels 10 on the gate bus line GL to which the above ON pulse is input, and the pixels 10 hold the voltage for an OFF period (one vertical scanning period). By repeating this process from the first line to the last line of the gate bus lines GL, an image in one vertical scanning period is displayed.

Figure 8A:
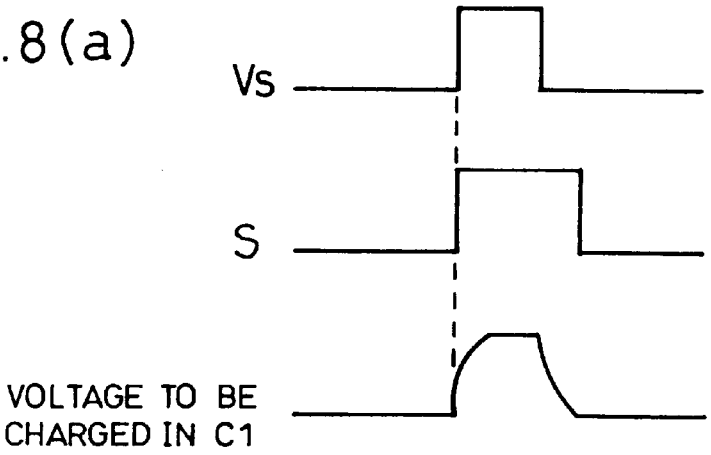
FIGS. 8(*a*) to 8(*c*) are views for schematically explaining the relationship among a video signal, a sampling pulse, and a sampling voltage to be charged in a sampling capacitor.
Figure 8B:
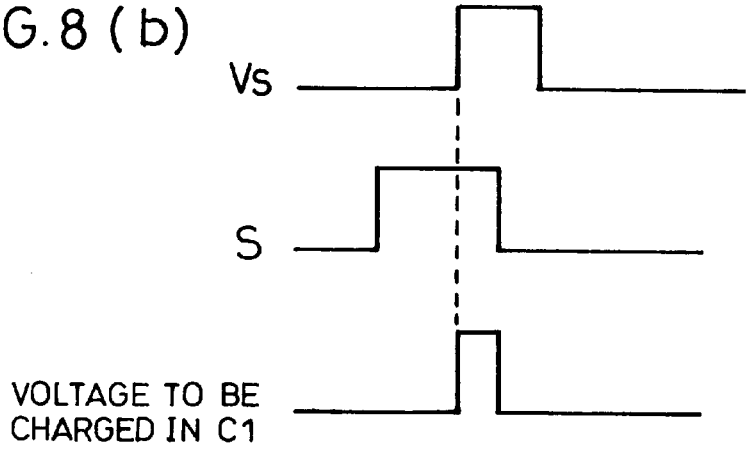
Figure 8C:
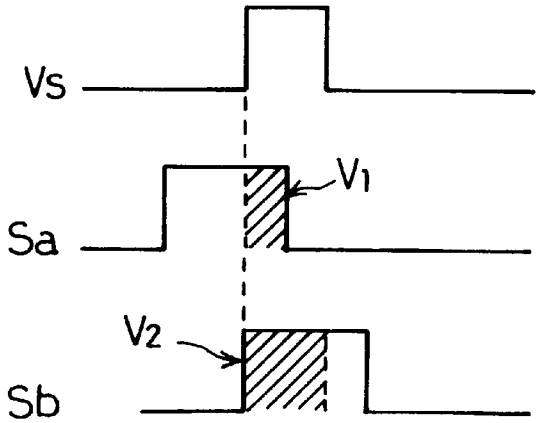

When the video signal Vs input to the sample-and-hold circuit 7*b* is a set of discrete signals, if the phase of the video signal Vs and the phase of the sampling pulse S have a relationship shown in FIG. 8(*a*), the voltage of the video signal Vs is charged in the sampling capacitor C1. On the other hand, if the phase of the video signal Vs and the phase of the sampling pulse S have a relationship shown in FIG. 8(*b*), the voltage of the video signal Vs cannot be sufficiently charged in the sampling capacitor C1. As a result, a sufficient signal voltage cannot be applied to the liquid crystal, preventing an excellent display.

In this embodiment, as described above, when the signal FR1 is at H level, the signal CLD 2 is output as the output signal CLD from the signal switching circuit 12 to the shift register 7*a* in the source driver 7. When the signal FR1 is at L level, the signal CLD 1 is output as the output signal CLD from the signal switching circuit 12 to the shift register 7*a*. It is therefore possible to change the phase relationship between the sampling pulse S generated based on the output signal CLD and the video signal Vs in each horizontal scanning period.

Figure 9:
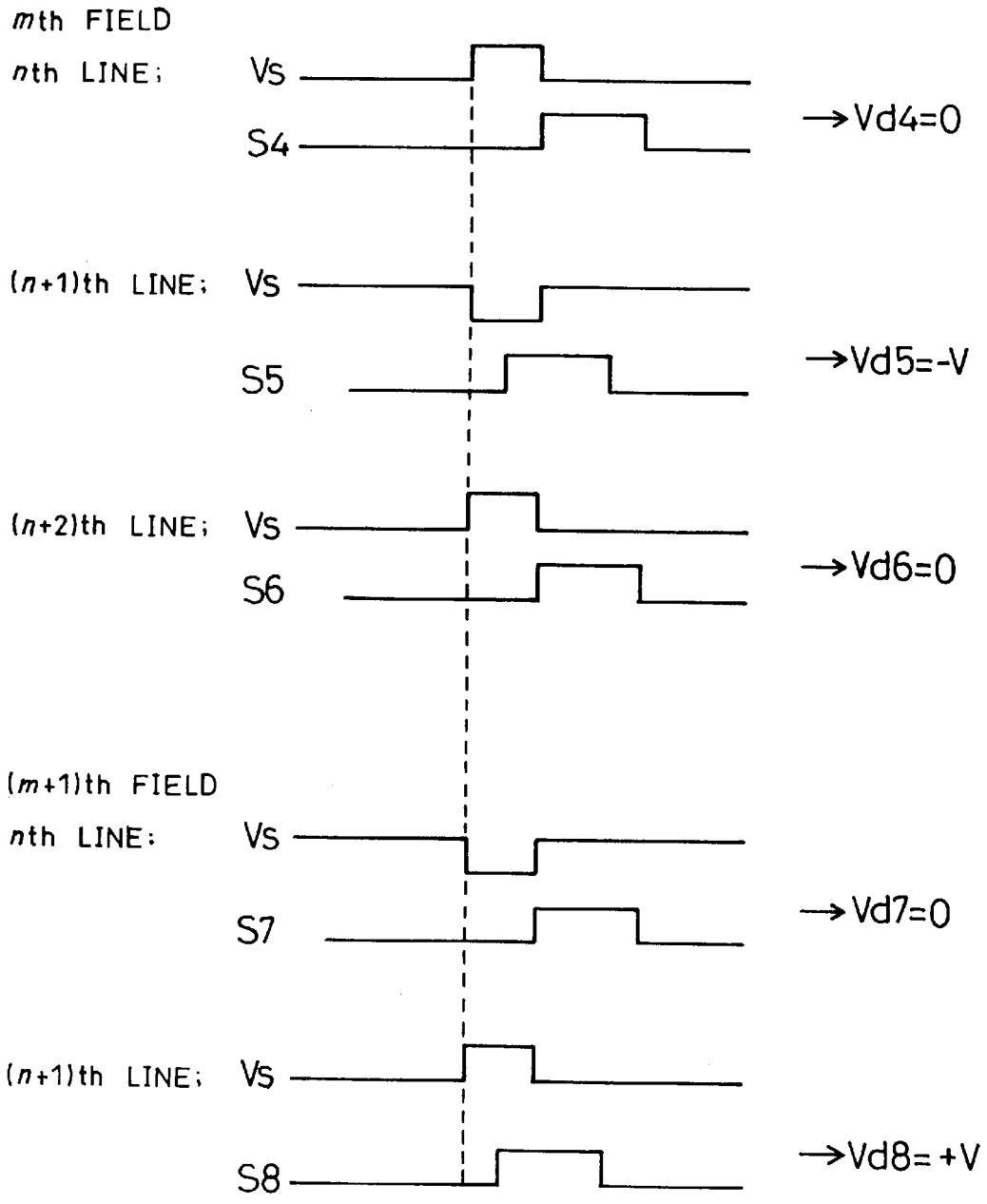
FIG. 9 is a view schematically explaining the relationship among a video signal, a sampling pulse, and a sampling voltage to be charged in a sampling capacitor.

However, in this structure, the output signal CLD for generating a signal voltage to be applied to the pixels 10 on the same line of respective fields is always the signal CLD1 or the signal CLD2. For example, as shown in FIG. 9, suppose that a sampling pulse S4 for the nth line of the mth field is generated based on the signal CLD1, a sampling pulse S5 for the (n+1)th line is generated based on the signal CLD2, and a sampling pulse S6 for the (n+2)th line is generated based on the signal CLD1, and that the phase relationship between the video signal Vs and the respective sampling pulses S are as shown in FIG. 9, a sampling voltage Vd to be charged in the sampling capacitor C1 is as follows. A sampling voltage Vd4 for the nth line of the mth field is 0. A sampling voltage Vd5 for the (n+1)th line is −V.

A sampling voltage Vd6 for the (n+2)th line is 0. Moreover, since a sampling pulse S7 for the nth line of the (m+1)th field is generated based on the signal CLD1 and a sampling pulse S8 for the (n+1)th line is generated based on the signal CLD2, a sampling voltage Vd7 for the nth line of the (m+1)th field is 0 and a sampling voltage Vd8 for the (n+1)th line is +V. In this state, no voltage is applied to the dots for the nth line, and the vertical line is displayed as a dashed or zigzag pattern.

Figure 10:
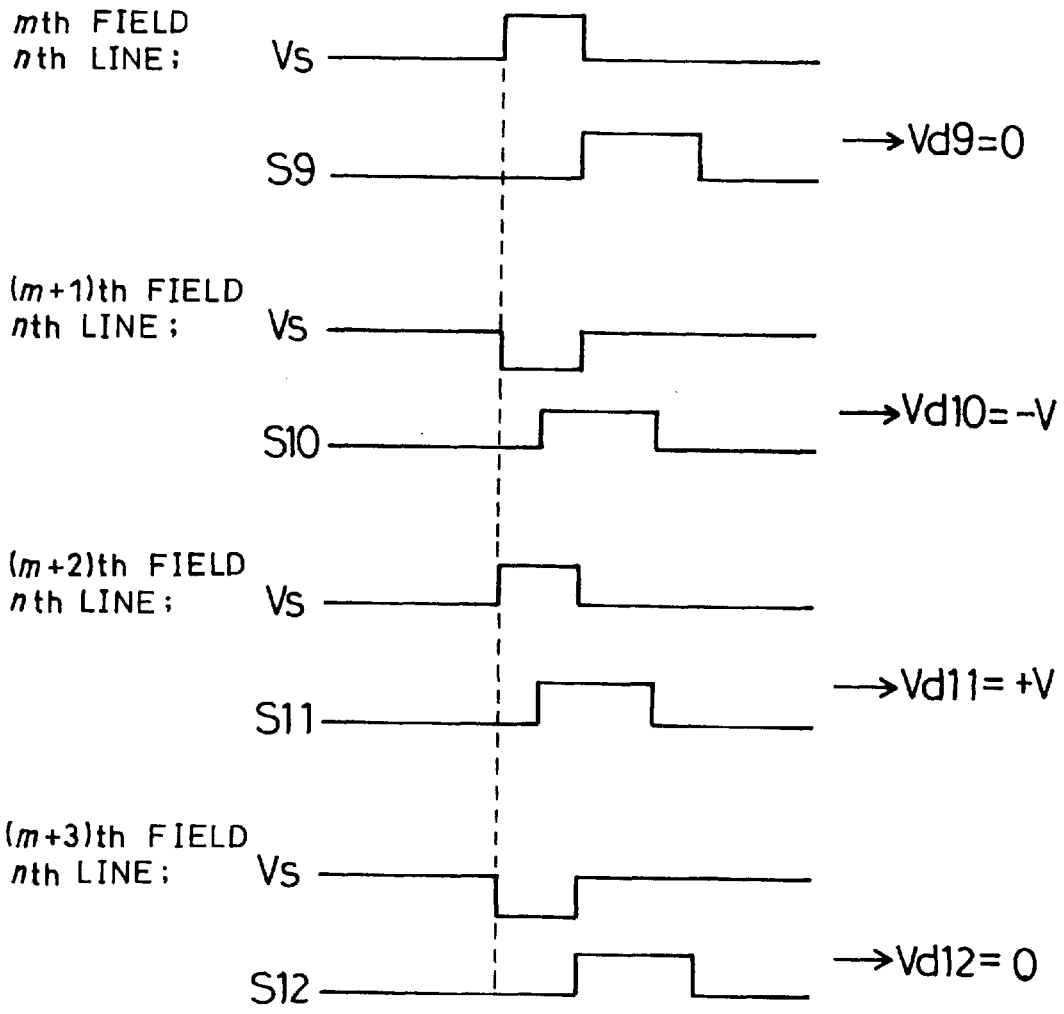
FIG. 10 is a view schematically explaining the relationship among a video signal, a sampling pulse, and a sampling voltage to be charged in a sampling capacitor according to this embodiment.
Figure 11:
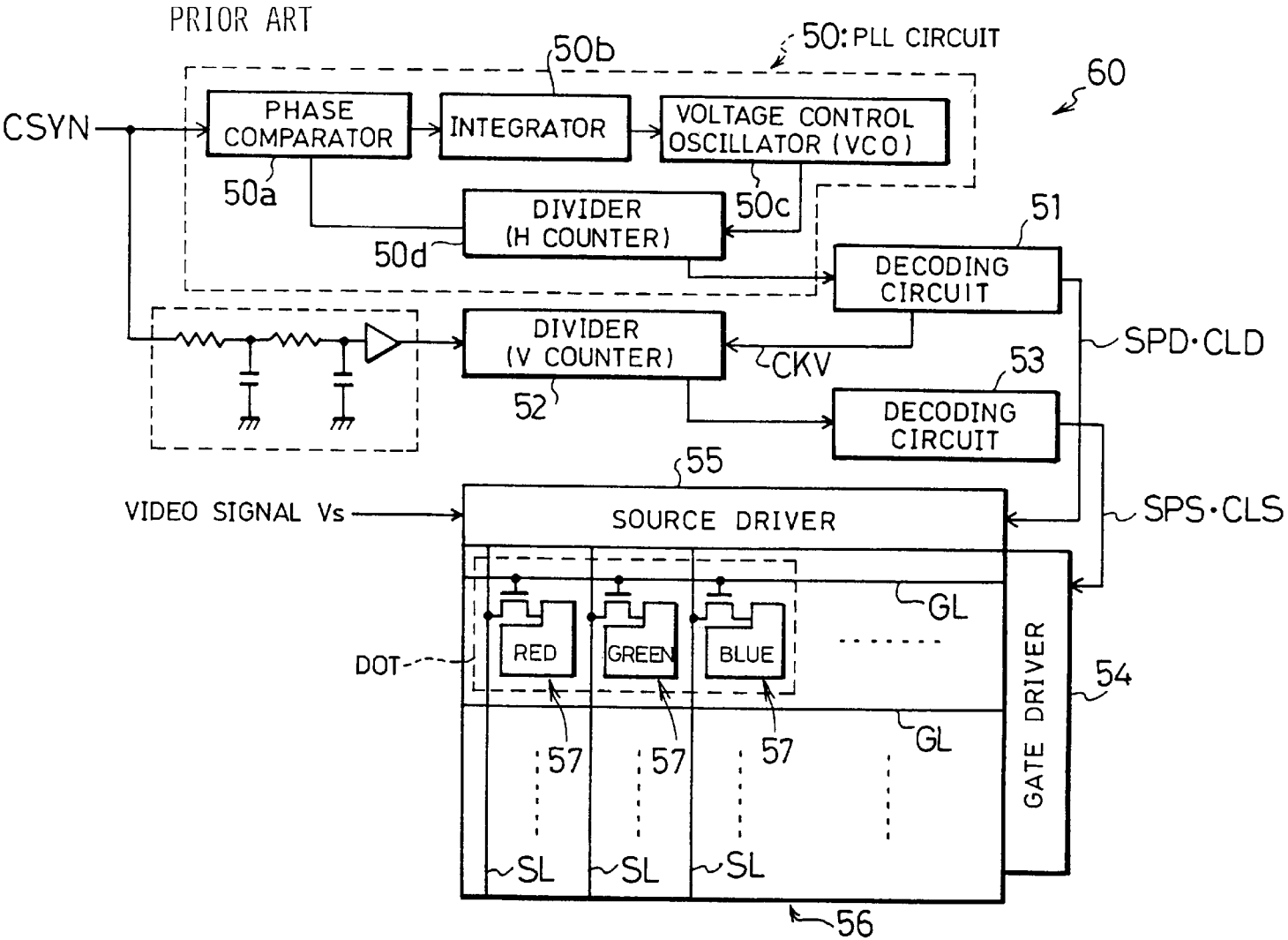
FIG.11 PRIOR ART
FIG. 11 is a block diagram showing an example of the structure of a conventional driving circuit for a liquid crystal display device.
Figure 12:
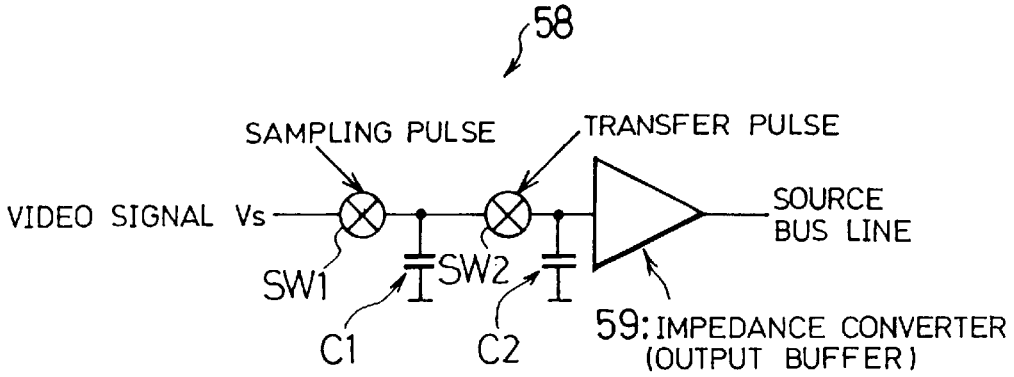
FIG. 12 PRIOR ART
FIG. 12 is a view schematically explaining a simplified structure of a sample-and-hold circuit used in the driving circuit shown in FIG. 11.
Figure 13:
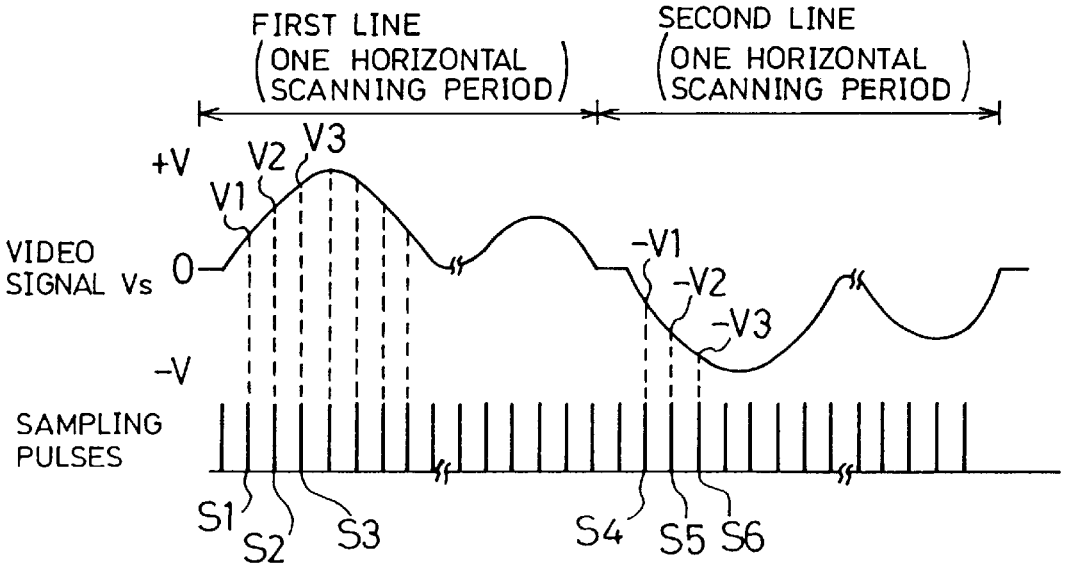
FIG. 13 PRIOR ART
FIG. 13 is a view schematically explaining a state of sampling when a continuously varying signal is input as a video signal to the driving circuit shown in FIG. 11.
Figure 14:
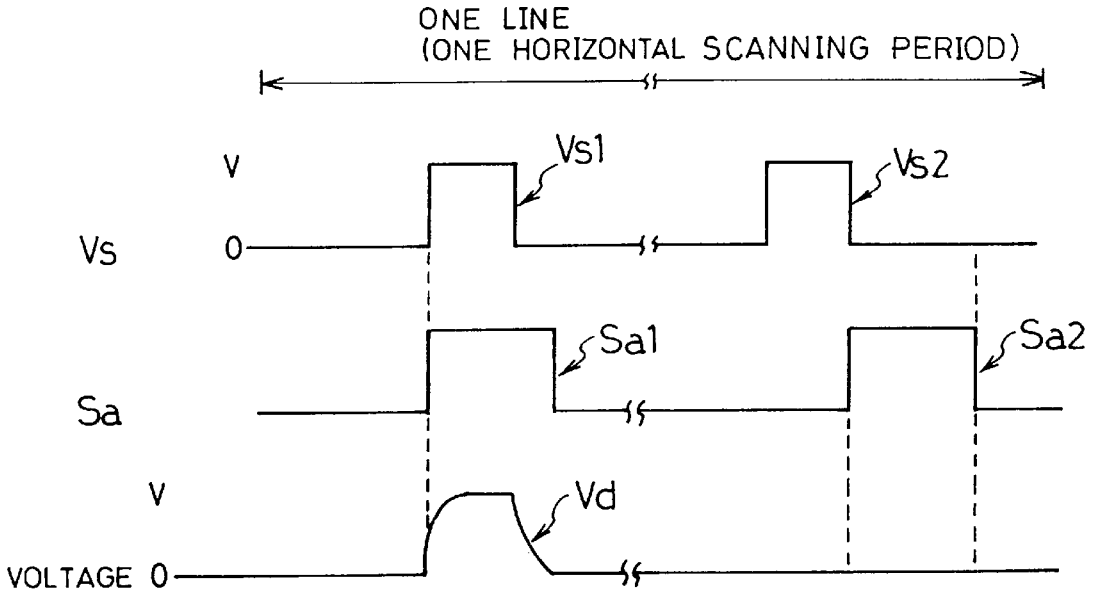
FIG. 14 PRIOR ART
FIG. 14 is a view schematically explaining a state of sampling when a set of discrete signals is input as a video signal to the driving circuit shown in FIG. 11.

However, in this embodiment, the signal generating circuit 1 switches the output signal CLD between two signals CLD1 and CLD2 in a set of four fields. In this case, as illustrated in FIG. 10, suppose that the output signal CLD is switched in a set of four fields so that a sampling pulse S9 for the nth line of the mth field is generated based on the signal CLD1, a sampling pulse S10 for the nth line of the (m+1)th field is generated based on the signal CLD2, a sampling pulse S11 for the nth line of the (m+2)th field is generated based on the signal CLD2, and a sampling pulse S12 for the nth line of the (m+3)th field is generated based on the signal CLD1 and that the video signal Vs and the respective sampling pulses S have the phase relationship shown in FIG. 10, the sampling voltage Vd to be charged in the sampling capacitor C1 is as follows. A sampling voltage Vd9 for the nth line of the mth field is 0. A sampling voltage Vd10 for the nth line of the (m+1)th field is −V. A sampling voltage Vd11 for the nth line of the (m+2)th field is +V. A sampling voltage Vd12 for the nth line of the (m+3)th field is 0. Hence, a voltage is certainly applied to the dot, thereby improving the display.

Namely, as shown in FIG. 8(*c*), when sampling pulses Sa and Sb are generated based on both the signals CLD1 and CLD2, respectively, and the voltage of the video signal Vs is charged as $V_1$ and $V_2$ (shown by hatching in FIG. 8(*c*)) in the sampling capacitor C1 by the sampling pulses Sa and Sb, respectively, the voltage which is actually applied to the liquid crystal on the same line is $(V_1+V_2)/2$.

As described above, the signal generating circuit 1 of this embodiment alternately outputs one of two signals CLD1 and CLD2 whose phases differ from each other to the source driver 7 in each horizontal scanning period, and also switches the output signal CLD between CLD1 and CLD2 within fields. It is thus possible to correct the sampling voltage (data voltage) which cannot be sampled by a conventional system when the sampling pulse S and the video signal Vs are out of phase, thereby providing an excellent display.

In this embodiment, the switching of the output signal CLD for the nth line in a set of four fields is performed so that the signal CLD1 is used in the mth field, the signal CLD2 is used in the (m+1)th field, the signal CLD2 is used in the (m+2)th field, and the signal CLD1 is used in the (m+3)th field. However, it is only necessary to switch the output signal CLD so as to prevent the application of a direct-current voltage to the liquid crystal. Therefore, for example, the output signal CLD may be switched every other field. In this case, the output signal CLD is switched so that the signal CLD1 is used for the mth field and the (m+1)th field, and the signal CLD2 is used for the (m+2)th field and the (m+3)th field, or the signal CLD2 is used for the mth field and the (m+1)th field and the signal CLD1 is used for the (m+2)th field and the (m+3)th field.

The structure of the signal generating circuit 1 is not necessarily limited to the one mentioned above, and it is possible to employ various circuit structures designed for alternately outputting one of two signals CLD1 and CLD2 whose phases differ from each other as the output signal CLD in each horizontal scanning period.

Moreover, the structure of the liquid crystal panel 9 is not limited to the one mentioned above, and, for example, a device other than TFT may be used as the switching element and the source driver 7 may be disposed on both sides of the pixel array 8.

Further, the driving circuit of the present invention can be applied to various devices, for example, an image display device having a data driver in which the timing of sampling and data are not synchronized, as well as to a liquid crystal display device.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A driving circuit for an image display device, comprising:

signal generating means for generating an initiation control signal for controlling an initiation of sampling of a video signal to be input and a sampling pulse timing signal for determining a timing of sampling based on an input composite synchronizing signal;

sampling pulse generating means for generating a sampling pulse based on said initiation control signal and said sampling pulse timing signal; and a sample-and-hold circuit for sampling and holding an input video signal in a horizontal scanning period of every horizontal scanning line at a timing of said sampling pulse, wherein when a set of discrete signals is input as said input video signal, said signal generating means generates at least two types of sampling pulse timing signals whose phases differ from each other, selects one type of sampling pulse timing signal from said at least two types of sampling pulse timing signals by turn in the horizontal scanning period, and outputs the selected sampling pulse timing signal to said sampling pulse generating means.

2. The driving circuit for an image display device according to claim 1, wherein said image display device is a liquid crystal display device comprising a liquid crystal panel having a striped color filter.

3. The driving circuit for an image display device according to claim 1, wherein said at least two types of sampling pulse timing signals generated by said signal generating means are two types of sampling pulse timing signals, and said signal generating means selects one type of sampling pulse timing signal from said two types of sampling pulse timing signals alternately in each horizontal scanning period, and outputs the selected sampling pulse timing signal to said sampling pulse generating means.

4. The driving circuit for an image display device according to claim 3, wherein said signal generating means switches said two types of sampling pulse timing signals alternately at intervals of two fields for a horizontal scanning line, and outputs the selected sampling pulse timing signal to said sampling pulse generating means.

5. The driving circuit for an image display device according to claim 3, wherein said signal generating means switches said two types of sampling pulse timing signals in a set of four fields for a horizontal scanning line, and outputs the selected sampling pulse timing signal to said sampling pulse generating means.

6. The driving circuit for an image display device according to claim 3, wherein said signal generating means switches said two types of sampling pulse timing signals in a set of four fields for a horizontal scanning line so that at least one type of sampling pulse timing signal is output in consecutive two fields for the horizontal scanning line, and outputs the selected sampling pulse timing signal to said sampling pulse generating means.

7. The driving circuit for an image display device according to claim 6, wherein said image display device is a liquid crystal display device comprising a liquid crystal panel having a striped color filter.

8. A liquid crystal display device comprising:

a liquid crystal panel having a striped color filter, and display-use pixels arranged in a matrix form, each of said pixels having a pixel electrode formed thereon; and a driving circuit for applying a signal voltage to each of said pixel electrodes, said driving circuit including signal generating means for generating an initiation control signal for controlling an initiation of sampling of a video signal to be input and a sampling pulse timing signal for determining a timing of sampling based on an input composite synchronizing signal;

sampling pulse generating means for generating a sampling pulse based on said initiation control signal and said sampling pulse timing signal; and a sample-and-hold circuit for sampling and holding an input video signal in a horizontal scanning period of every horizontal scanning line at a timing of said sampling pulse, wherein when a set of discrete signals is input as said input video signal, said signal generating means generates at least two types of sampling pulse timing signals whose phases differ from each other, selects one type of sampling pulse timing signal from said at least two types of sampling pulse timing signals by turn in each horizontal scanning period, and outputs the selected sampling pulse timing signal to said sampling pulse generating means.

9. The liquid crystal display device according to claim 8, wherein said at least two types of sampling pulse timing signals generated by said signal generating means are two types of sampling timing signals, and said signal generating means selects one type of sampling pulse timing signal from said two types of sampling pulse timing signals alternately in each horizontal scanning period, and outputs the selected sampling pulse timing signal to said sampling pulse generating means.

10. The liquid crystal display device according to claim 9, wherein said signal generating means switches said two types of sampling pulse timing signals in a set of four fields for a horizontal scanning line so that at least one type of sampling pulse timing signal is output in consecutive two fields for the horizontal scanning line, and outputs the selected sampling pulse timing signal to said sampling pulse generating means.

11. A method of driving an image display device comprising the steps of:

a) generating an initiation control signal for controlling an initiation of sampling of a video signal to be input and a sampling pulse timing signal for determining a timing of sampling based on an input composite synchronizing signal;

b) generating a sampling pulse based on the initiation control signal and the sampling pulse timing signal; and c) sampling and holding an input video signal in a horizontal scanning period of every horizontal scanning line at a timing of the sampling pulse, wherein when a set of discrete signals is input as the input video signal, said step a) comprises generating at least two types of sampling pulse timing signals having different phases, selecting one type of sampling pulse timing signal from the at least two types of sampling pulse timing signals by turn in the horizontal scanning period, and providing the selected sampling pulse timing signal as the sampling pulse timing signal.

12. The method of driving an image display device according to claim 11, wherein the at least two types of sampling pulse timing signals generated in said step a) are two types of sampling pulse timing signals, one type of sampling pulse timing signal being selected from the two types of sampling pulse timing signals alternately in each horizontal scanning period and being provided as the sampling pulse timing signal.

13. The method of driving an image display device according to claim 12, wherein said step a) comprises switching the two types of sampling pulse timing signals in a set of four fields for a horizontal scanning line so that at least one type of sampling pulse timing signal is provided in consecutive two fields for the horizontal scanning line, and providing the selected sampling pulse timing signal as the sampling pulse timing signal.

14. The method of driving an image display device according to claim 13, wherein the image display device is a liquid crystal display device comprising a liquid crystal panel having a striped color filter.

15. The method of driving an image display device according to claim 12, wherein said step a) comprises switching the two types of sampling pulse timing signals alternately at intervals of two fields for a horizontal scanning line and providing the selected sampling pulse timing signal as the sampling pulse time signal.

16. The method of driving an image display device according to claim 12, wherein said step a) comprises switching the two types of sampling pulse timing signals in a set of four fields for a horizontal scanning line and providing the selected sampling pulse timing signal as the sampling pulse timing signal.

17. The method of driving an image display device according to claim 11, wherein the image display device is a liquid crystal display device comprising a liquid crystal panel having a striped color filter.

* * * * *